US005392915A

United States Patent [19]

Kalin

[11] Patent Number: 5,392,915

[45] Date of Patent: Feb. 28, 1995

[54] CRATE APPARATUS WITH ADJUSTABLE LID

[75] Inventor: Jonathan Kalin, Manhattan Beach, Calif.

[73] Assignee: Rehrig-Pacific Company, Inc., Los Angeles, Calif.

[21] Appl. No.: 115,830

[22] Filed: Sep. 3, 1993

[51] Int. Cl.[6] ..... B65D 21/00

[52] U.S. Cl. ..... 206/503; 206/508

[58] Field of Search ..... 206/503, 506, 508, 509, 206/511; 220/315, 323

[56] References Cited

U.S. PATENT DOCUMENTS

| | | | |
|---|---|---|---|
| D. 319,522 | 8/1991 | Umiker | D34/40 |
| 2,655,283 | 10/1953 | Moldt | 220/22 |
| 3,376,046 | 4/1968 | Kivett et al. | 206/508 X |
| 3,416,704 | 12/1968 | Frater | 220/97 |
| 3,642,165 | 2/1972 | von der Osten | 206/503 X |
| 3,762,594 | 10/1973 | Utz | 220/21 |
| 4,113,329 | 9/1978 | Thurman | 312/111 |
| 4,440,302 | 4/1984 | Ehrman et al. | 206/506 |
| 4,501,355 | 2/1985 | Hoffman | 206/503 X |
| 4,519,503 | 5/1985 | Wilson | 206/505 |
| 4,523,692 | 6/1985 | Lemkin | 220/315 X |
| 4,759,451 | 7/1988 | Apps | 211/126 |
| 4,842,142 | 6/1989 | Kreeger | 206/506 X |
| 4,982,844 | 1/1991 | Madan et al. | 206/506 |
| 5,035,326 | 7/1991 | Stahl | 206/507 |

*Primary Examiner*—Steven M. Pollard

*Attorney, Agent, or Firm*—Banner, Birch, McKie & Beckett

[57] ABSTRACT

A stackable and nestable crate apparatus particularly adapted for the transport and storage of easily breakable products, such as potato chips, or the like, includes an open topped container body of unitary molded plastic construction. A lid extends across the open top of the container body and is mountable thereon at various selected elevations to vertically support an overlying, stacked crate apparatus at a level suitable for the size of the product housed within the supporting crate apparatus. The front and rear walls of the container body are appropriately recessed to permit relative sliding movement between adjacent, stacked crates. The peripheral dimensions of the lid are correlated with respect to those of the interior of the container body to enable ready access to the product within a crate apparatus when slidably extended from the stack and to permit the lid, when rotated, to be readily received within the container body in order to accommodate nesting of empty crates.

32 Claims, 13 Drawing Sheets

CRATE APPARATUS WITH ADJUSTABLE LID

BACKGROUND OF THE INVENTION

The present invention relates to a stackable and nestable crate apparatus for use in the transport and storage of upstanding bags containing food product of a brittle, easily breakable nature, such as potato chips, pretzels, or the like. More particularly, the invention relates to crate apparatus of the concerned type including a lid cooperative with a molded plastic container body to permit adjustment of the lid position depending upon the size of the bags housed within the container body.

It is well known to employ covered crate apparatus for the transport of goods. Such apparatus is commonly constructed from cardboard in which the fold in the cardboard along the edge of the case portion serves as a hinge. Cases of this type are undesirable in that, being made of cardboard, they are subject to rapid deterioration, particularly when they are exposed to wet conditions. Also, such cases are prone to fail due to the repeated bending of the cardboard hinge. An additional disadvantage results, moreover, from the fact that case apparatus of this type, in order to effectively contain product in bags of variable sizes, must either be produced in several sizes, thereby increasing the magnitude of the inventory which must be maintained or, alternatively, must be dimensioned to accommodate bags of the greatest contemplated size whereupon, when bags of smaller size are shipped, an amount of empty excess volume must be tolerated.

It is to the amelioration of these problems, therefore, to which the present invention is directed.

SUMMARY OF THE INVENTION

Accordingly, there is provided a stackable, nestable crate apparatus comprising a container body including a bottom wall and a plurality of generally rectangularly disposed front, back and side walls extending upwardly from said bottom wall to define an open top; means forming a lid operative for stackedly supporting a similarly formed container body thereon adapted to extend across the open top of said container body in spaced, substantially parallel relation to said bottom wall; and means for selectively mounting said lid on said container body at a plurality of vertically spaced levels with respect to said container body bottom wall.

The mounting means includes a plurality of seats arranged in sets of four or more for supporting the lid at selectively variable elevations within the container body whereupon the lid in each position operatively extends across the open top of the container body to cover and thereby protect the bags containing easily damageable food product thus to permit stacking of the crate apparatus. The seats that comprise the respective sets are disposed in groups located along opposite side walls of the container body to maintain uniform spacing between the seats in each set. In the preferred embodiment of the invention, the seats are each defined by a shoulder formed at the closed end of an elongated recess or groove which extends upwardly along the interior surface of the container side wall and that opens at the upper end thereof. With seats so arranged, manipulation of the lid to the various selected mountings is facilitated. The recesses or grooves may be defined by pockets formed on the respective walls of the container body in order to reduce the thickness requirement thereof.

Moreover, in the described apparatus, while means are provided to restrict unintentional sliding movement between adjacent, stacked crate apparatus, the container body in each crate apparatus is configured to permit intentional, drawer-like relative sliding movement with respect to a lid on a subjacent stacked crate apparatus. Also, the lid member in each crate apparatus is advantageously dimensioned with respect to the open top of the container body to provide access to the interior of the container body when it is extended from the stack in order to permit ready withdrawal of bags of product. Such dimensioning of the lid member, particularly with respect to the dimensional configuration of the container body, further enables the lid member to be readily received in the bottom of the container body so as to permit nesting of the crate apparatus when empty.

Accordingly, it is an object of the present invention to provide an improved stackable and nestable crate apparatus which is capable of effectively accommodating bagged product of variable sizes.

It is a further object of the invention to provide an improved crate apparatus of the concerned type which is designed to occupy less space when in a loaded, stacked condition as well as when in a nested condition.

Yet another object of the invention is to provide a crate apparatus of the concerned type constructed of sturdy, light weight plastic material and in which the lid, that protectively overlies the contained product and that permits stacking, is mountable at various elevations in its associated container body whereupon compact stacking, depending upon the size of the contained product, can be achieved.

A still further advantage of the present invention is to provide an improved crate apparatus of the concerned type that permits sliding extension of selected stacked container bodies and ready access to the interior thereof whereby contained product can be removed from an intermediate location in the stack.

For a better understanding of the invention, its operating advantages and the specific objectives obtained by its use, reference should be made to the accompanying drawings and description which relate to a preferred embodiment thereof.

DETAILED DESCRIPTION OF THE PREFERRED EMBODIMENTS

Figure 1:
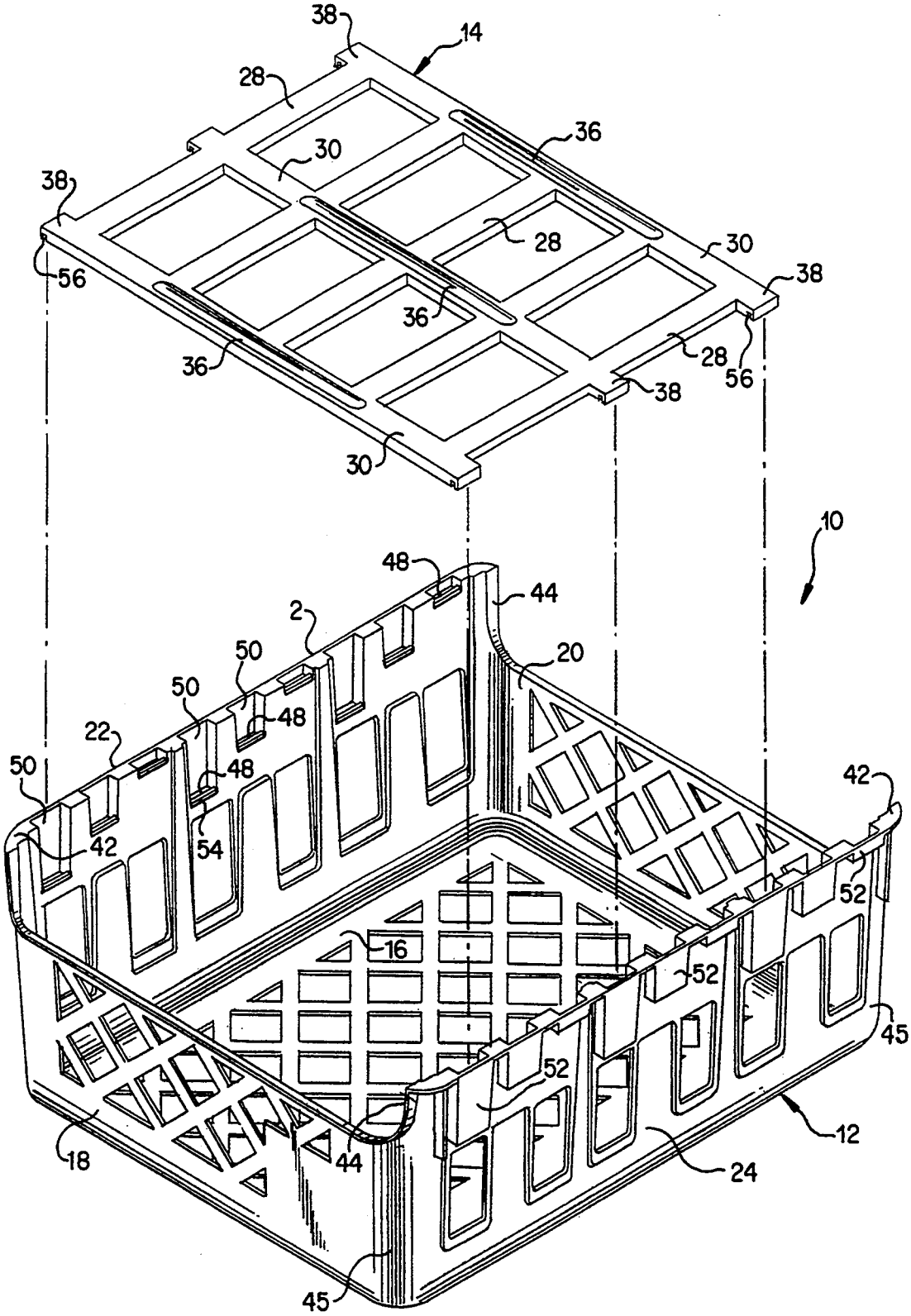
FIG. 1 is an exploded perspective view of a container body and a lid forming crate apparatus according to the present invention.
Figure 2:
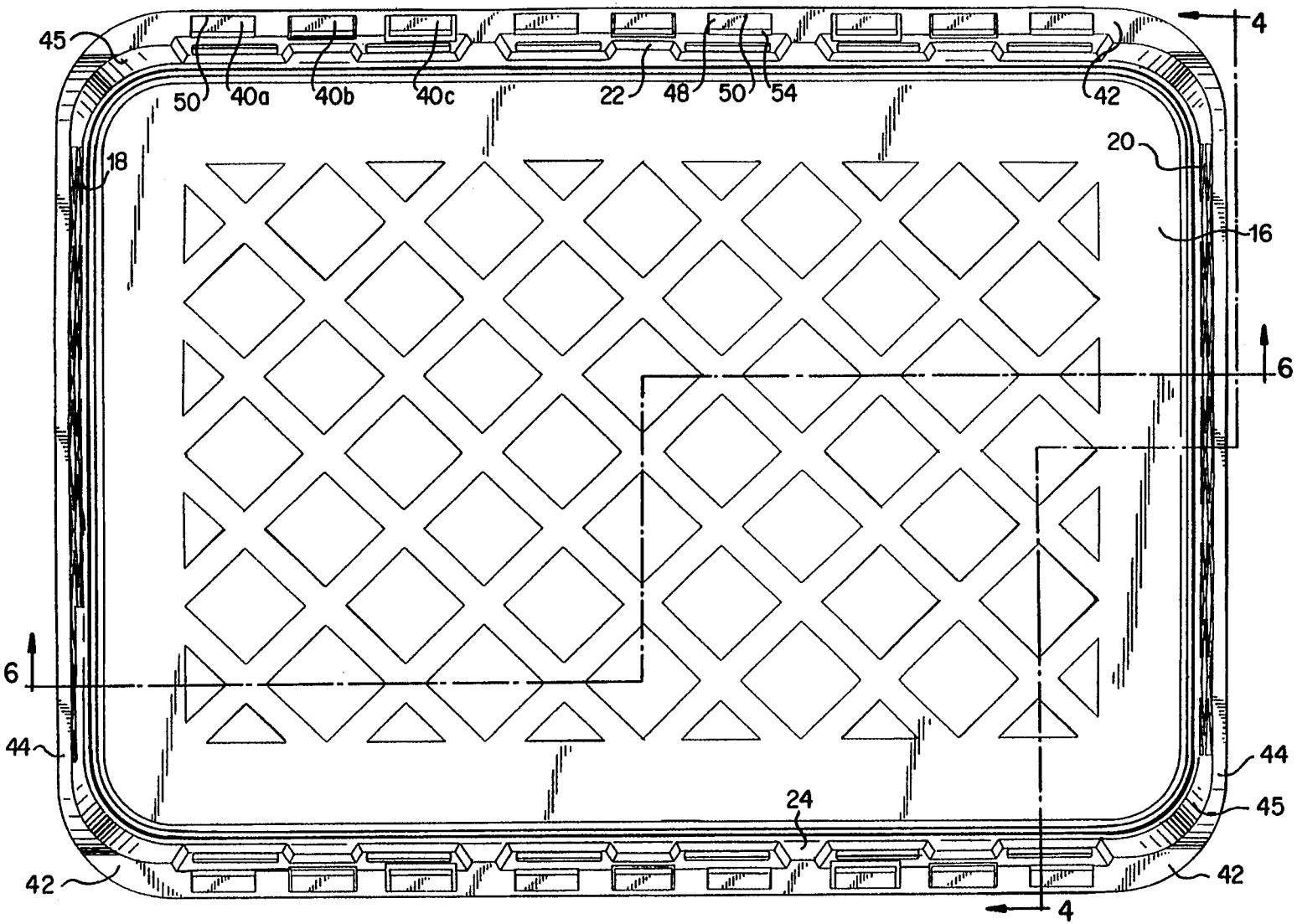
FIG. 2 is a top plan view of the container body of FIG. 1.
Figure 3:
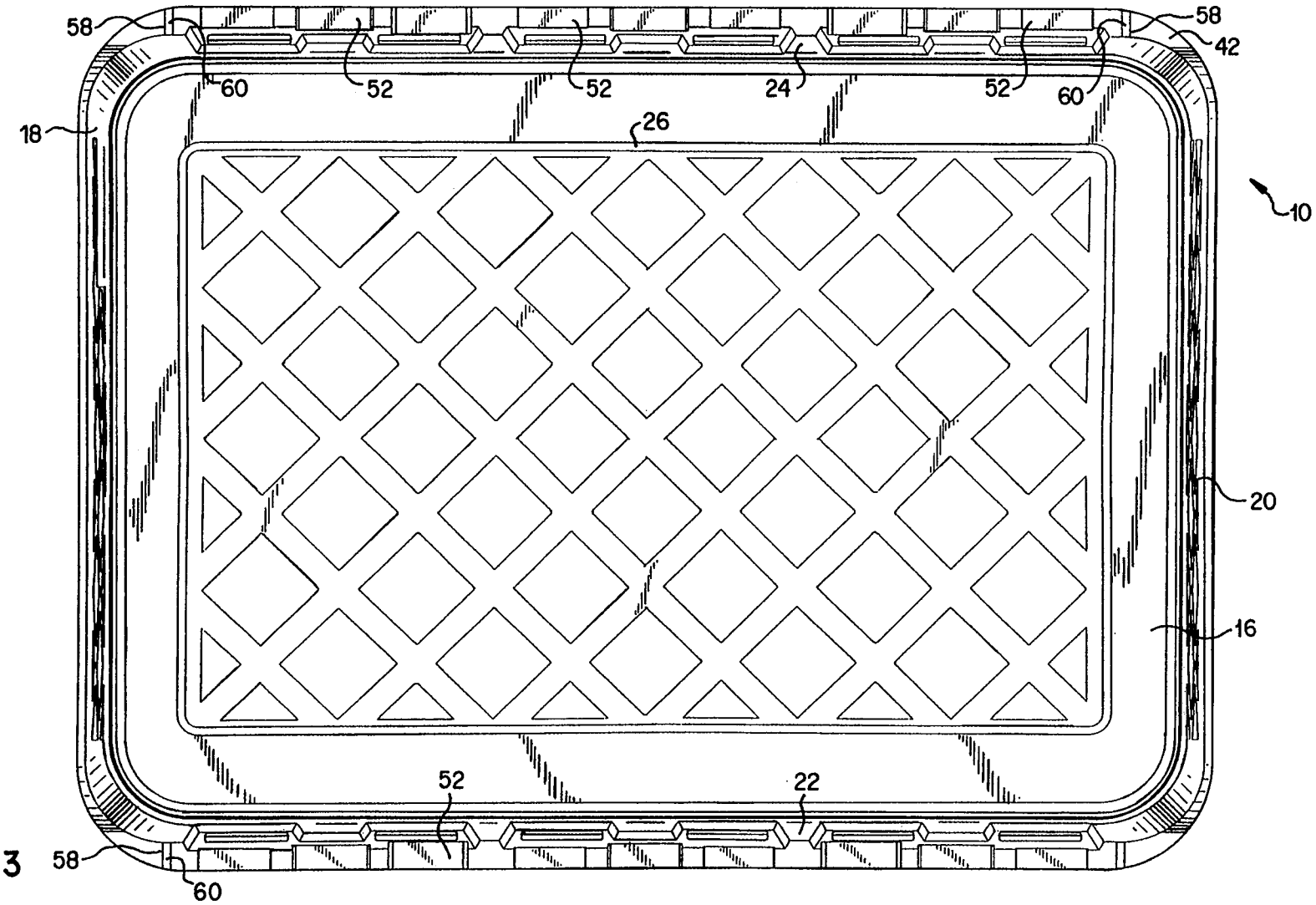
FIG. 3 is a bottom plan view of the container body of FIG. 1.
Figure 4:
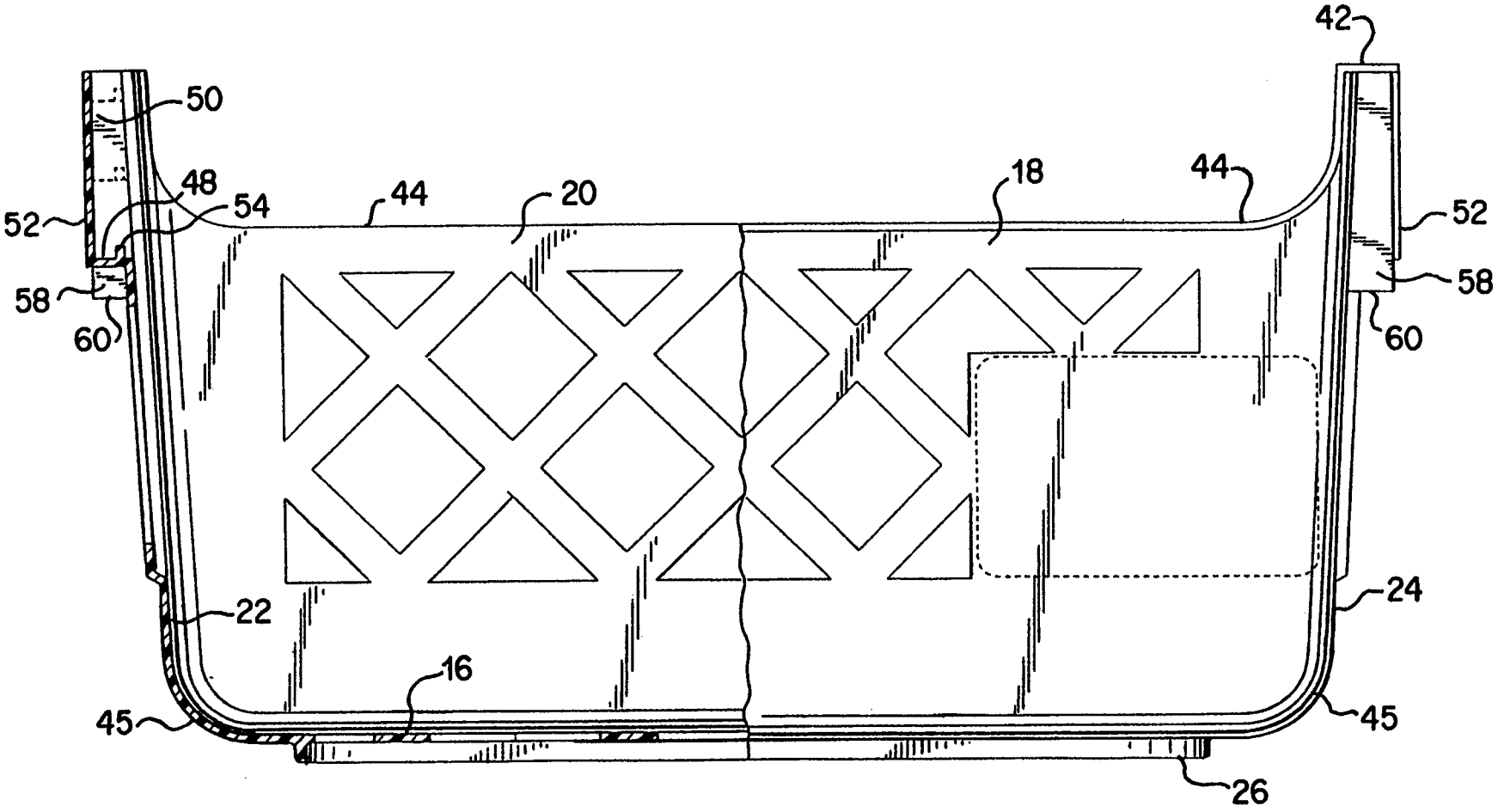
FIG. 4 is an end view, partly in section, of the container body of FIG. 1.
Figure 5:
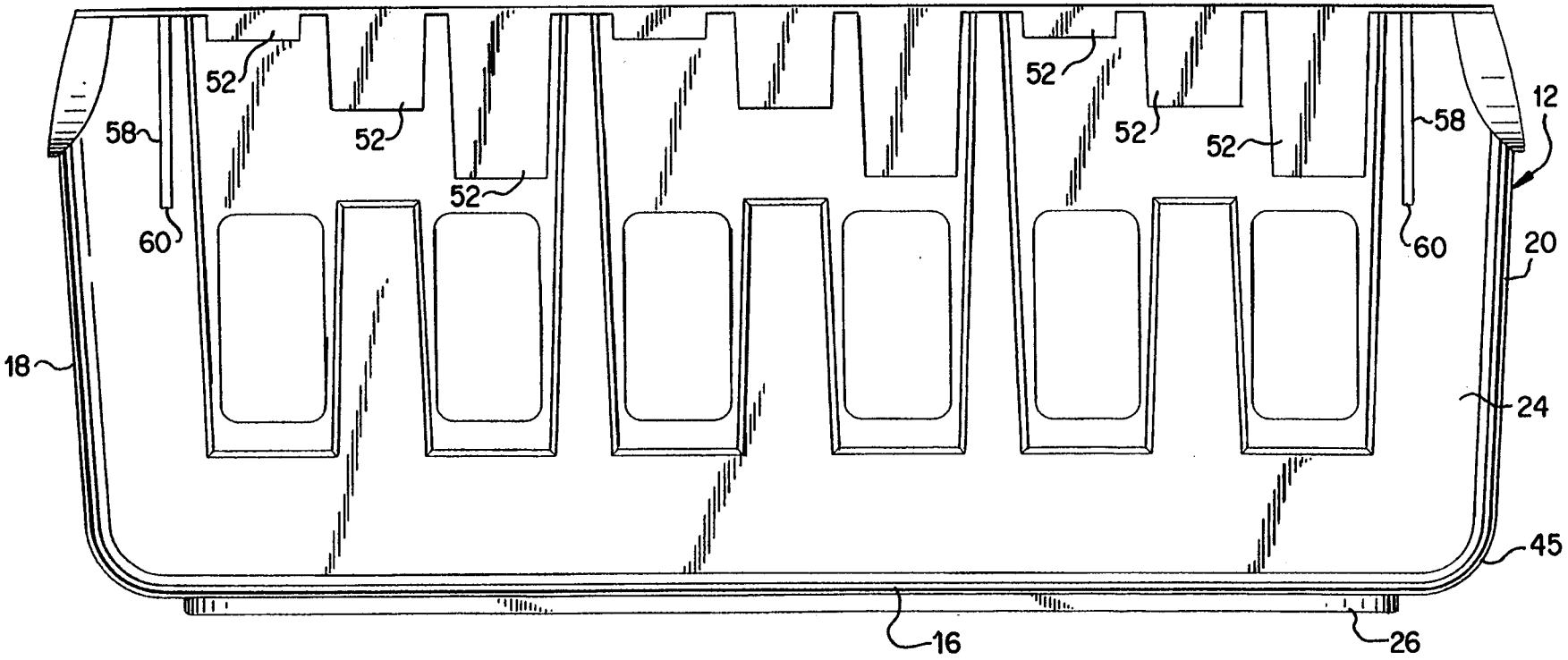
FIG. 5 is a side elevational view of the container body of FIG. 1.
Figure 6:
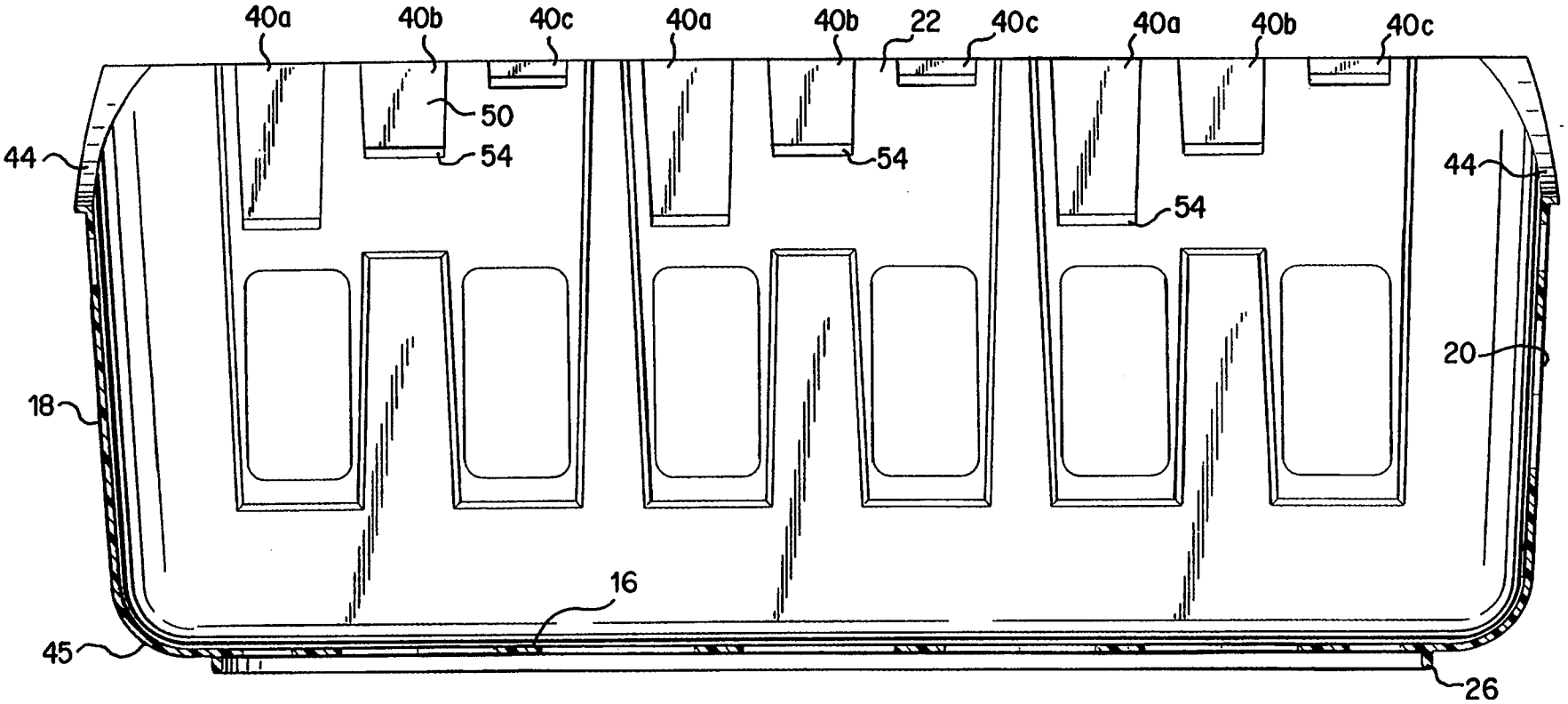
FIG. 6 is a longitudinal sectional view taken along line 6—6 of FIG. 2.

The described apparatus, identified generally in the drawings by reference numeral 10, is particularly adapted for the storage and transport of readily crumbleable or breakable food products, such as potato chips, pretzels and the like, which products are commonly packaged in bags. The crate apparatus comprises essentially an open topped container body 12 and a lid 14. The container body 12, which may be formed, for example, from high density polyethylene, or similar material, includes a bottom wall 16 and upwardly extending and transversely-directed front and rear end walls 18 and 20 and longitudinally-directed opposed side walls 22 and 24. The bottom surface of bottom wall 16 is provided with a rectangularly disposed depending rib 26 that conveniently serves as a wear strip. The effective depth of the interior of the container body 12, as defined by the upwardly extending walls 18 to 24, is such as to permit bags of product to be packed in an upstanding attitude within the interior of the container body.

The lid 14 is a member that is separate from the container body 12 and has as its principle function to protectively overlie the top of the bags stored in the container body and to thereby permit vertical stacking of similarly formed crate apparatus 10 during periods of transport and storage. While the lid member 14 may be formed of the same material as the container body 12, its strength characteristics are such that it desirably will undergo little or no transverse bending or flexure when operatively connected to the container body.

Figure 13:
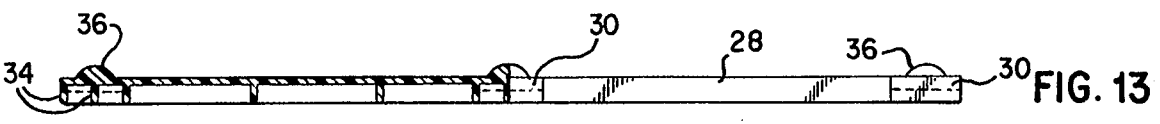
FIG. 13 is an end view, partly in section, of the lid member of FIG. 10.
Figure 12:
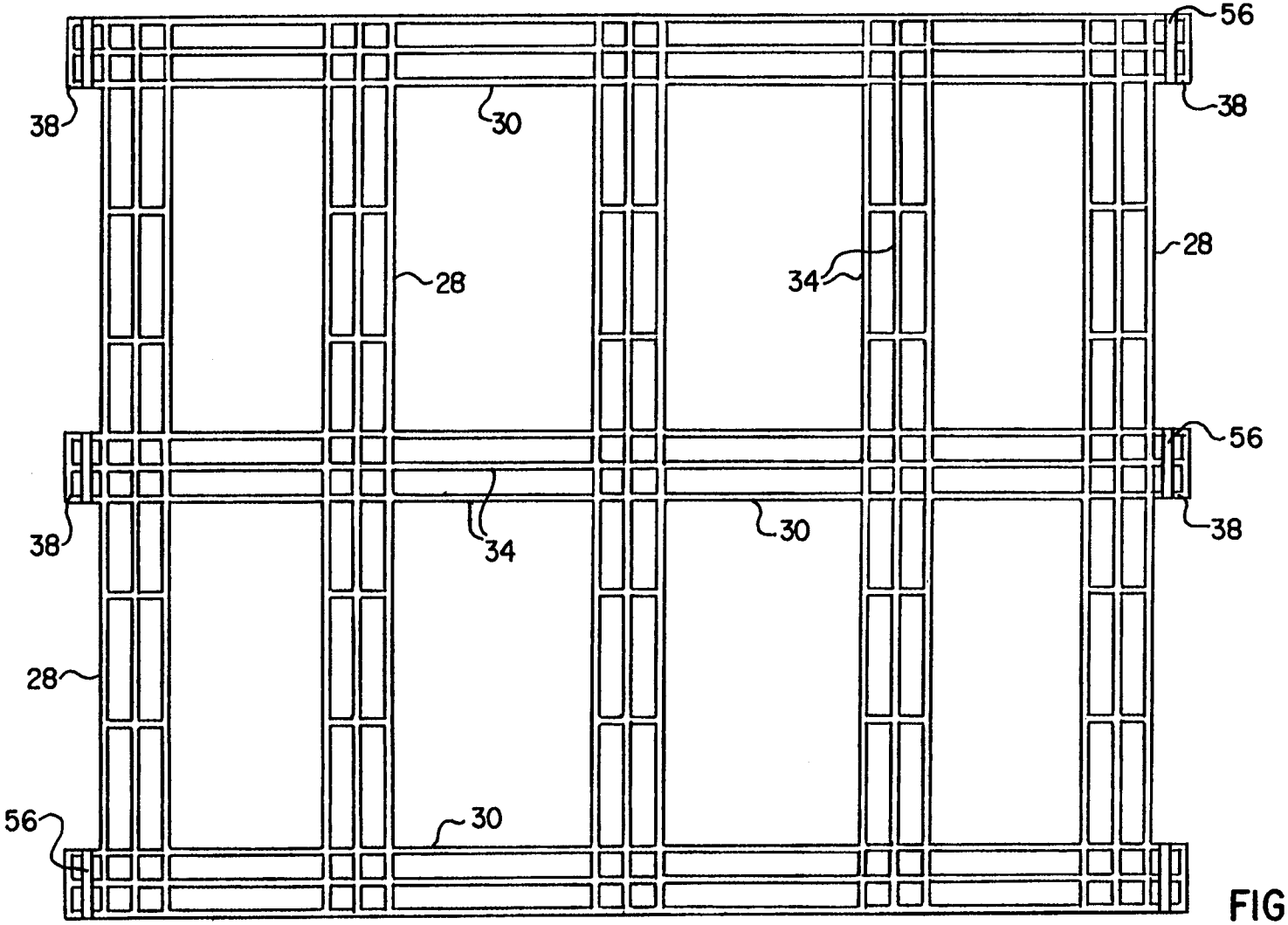
FIG. 12 is a bottom view of the lid member of FIG. 10.
Figure 14:
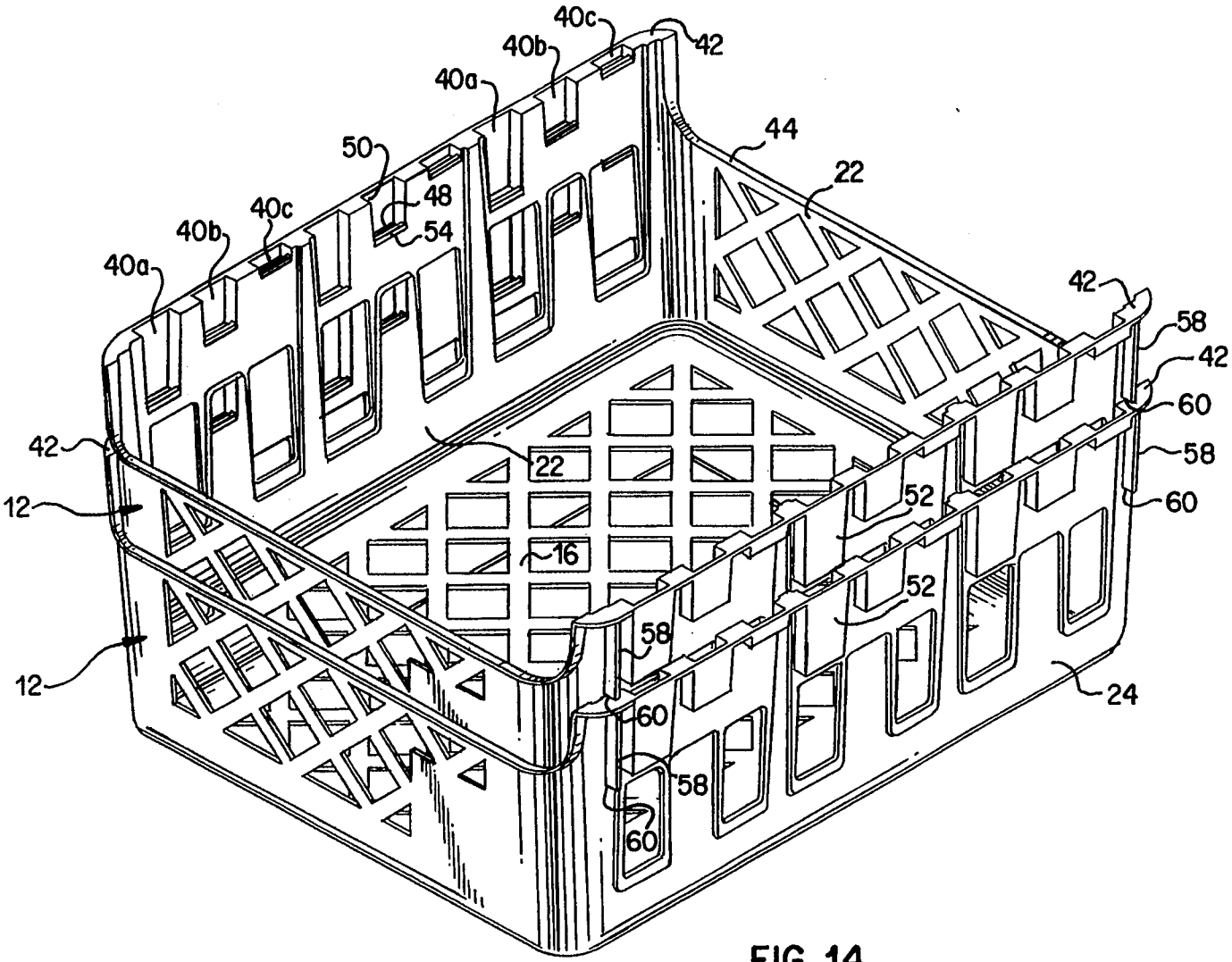
FIG. 14 is a perspective view illustrating crate apparatus according to the present invention in a nested condition.

In the described arrangement, the lid member 14 has a generally rectangular shape provided by a plurality of intersecting longitudinal and lateral struts 28 and 30, respectively. As shown in FIGS. 12 and 13, the struts 28 and 30, which define the lid member 14, are integrally formed as a molded plastic body. A plurality of parallel ribs 34 depend from the lower surface of each respective strut to rigidify the lid member structure. Also, the upper surface of each lateral strut 30 contains an upwardly projecting transverse rib 36 that cooperates with the rib 26 on the container body bottom wall 16 to restrain stacked crate members 10 against undue relative movement. The dimensions of the cooperating ribs 26 and 36 are such that, while unintentional relative movement between adjacent crate members is restrained, intentional relative movement between the members, as may be desired in order to obtain access to the interior of a container body in a lower disposition in the stack is not prevented. Lateral struts 30, as shown, extend beyond the outside edges of the outermost longitudinal struts and thereby define feet 38 for mounted engagement with seats 40 formed on opposite walls of the container body 12, as hereinafter more fully described.

In order to enhance stacking of the crate apparatus 10 and nesting of the container bodies thereof, the upwardly extending walls 18 to 24 are inclined upwardly and outwardly such that the peripheral dimensions of each container body are correspondingly greater at the open top defined by rim 42 as compared with adjacent the bottom wall 16.

Relative sliding movement between adjacent stacked crate apparatus between a position in which there is substantial registration between adjacent apparatus and one in which one apparatus is extended with respect to the adjacent apparatus is permitted by means of recesses 44 formed in the opposed front and rear end walls 18 and 20. Moreover, this relative sliding movement between respective stacked crate apparatus 10 can be facilitated by the formation, as shown, of all of the corners formed by the intersection of the respective walls with a substantial radius 45. In the illustrated example, a radius of about one inch is found effective for rounding the comers on crate apparatus 10 having dimensions of approximately 18 inches by 24 inches by about 9 inches deep.

Advantageously, the lid member 14 has a length in the longitudinal direction that is significantly less than the longitudinal dimension of the interior of the container body 12. Accordingly, access spaces **46*a* and 46*b*** to the container body interior are provided as, for example, for the removal of one or more of the stored bags when the concerned crate apparatus is moved to its extended position.

According to the invention, provision is made to permit vertical adjustment of the mounting for the lid member 14 in order to reduce stack heights commensurate with the size of the product-bearing bags stored in the crate apparatus 10. This is accomplished by adjustment of the disposition of the lid member 14 which enables it to be placed in close superposed relation over the bags in the container body 12, regardless of whether bags of large-, medium- or small-size are stored therein. Thus, stacking of the several crate apparatus 10 will be more compact and will obtain substantially the minimum height that the size of the stored bags will permit.

The adjustability of the lid 14 is achieved by the container bodies 12 being each provided with sets of seats 40 adapted to receive the feet 38 on the lid member 14 and thereby mount the lid member in a horizontal disposition with respect to the container body. Each seat set, of which there are three in the described arrangement, consists primarily of four rectangularly disposed seats 40 that receive the feet 38 for supporting the lid member at a particular elevation. Desirably, in the described arrangement, additional seats 40 are provided at intermediate positions on opposite sides of the lid member in order to render the member less prone to bend or flex under a stacked load. The seats 40 in each set are disposed at the same elevation and on a longitudinal spacing that corresponds to the longitudinal spacing between the feet 38 on each transverse side of the lid member so that, when installed in the seats, the lid member 14 will assume a substantially level, horizontal attitude.

Each seat 40 is formed by a shouldered surface 48 which defines the bottom end of a vertically extending recess or groove 50 positioned in the interior surface of the respective side walls 22 and 24. Preferably, in order to maintain the thin-wailed configuration of the container body 12, each recess or groove 50 is formed by a generally rectangular receptacle or pocket 52 that projects from the exterior surfaces of the respective side wails 22 and 24 and that is open at the upper edge thereof in order to facilitate placement of the lid member feet 38 onto seats 40. If desired, a transverse ridge 54 upstanding from the surface of each shoulder 48 of seats 40, may be provided to engage a cooperating slot 56 on the bottom side of each foot 38 thereby to add stability to the mounting.

Figure 7:
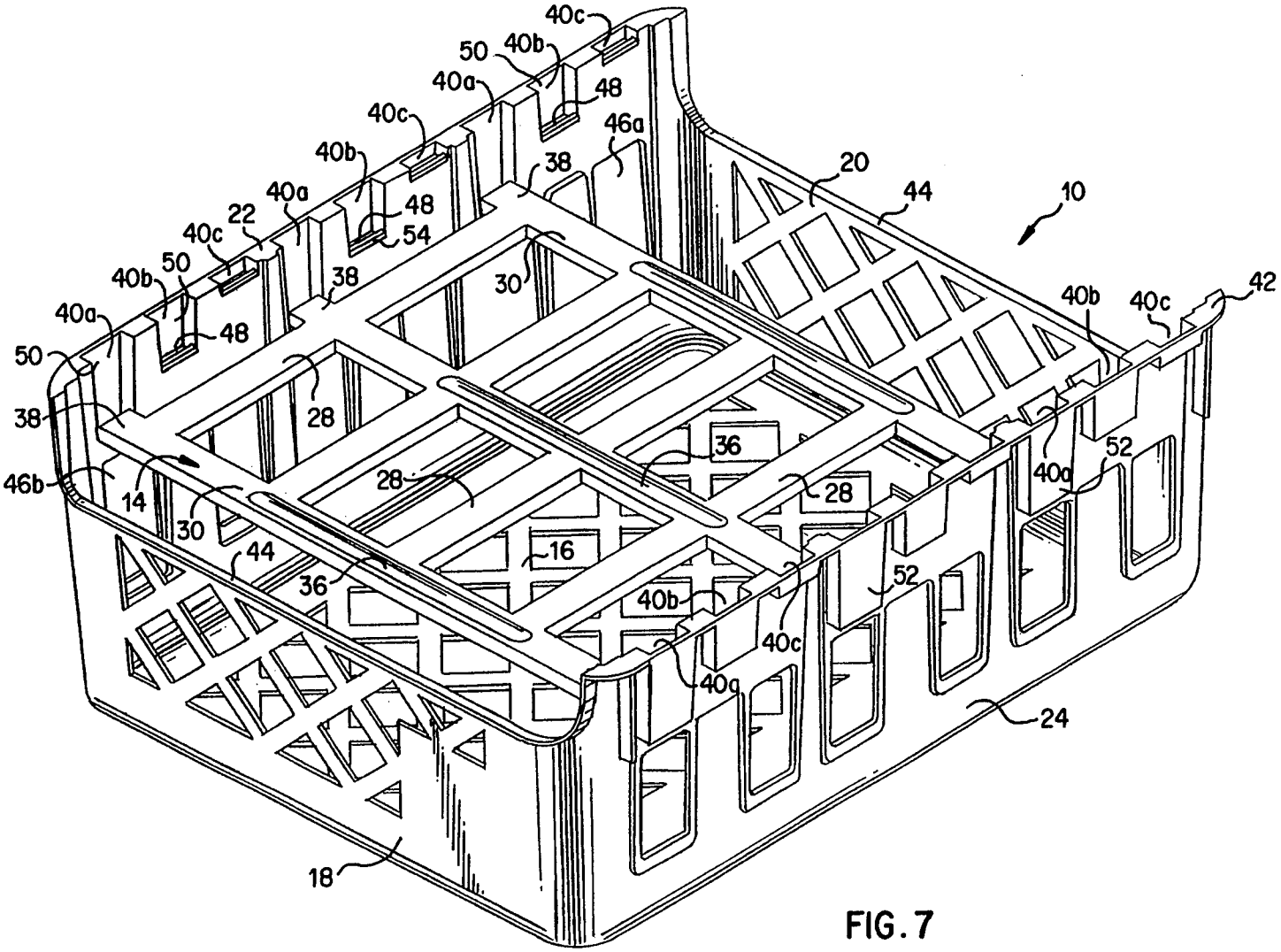
FIGS. 7, 8 and 9 are perspective views illustrating the lid member in alternate positions within the container body.
Figure 8:
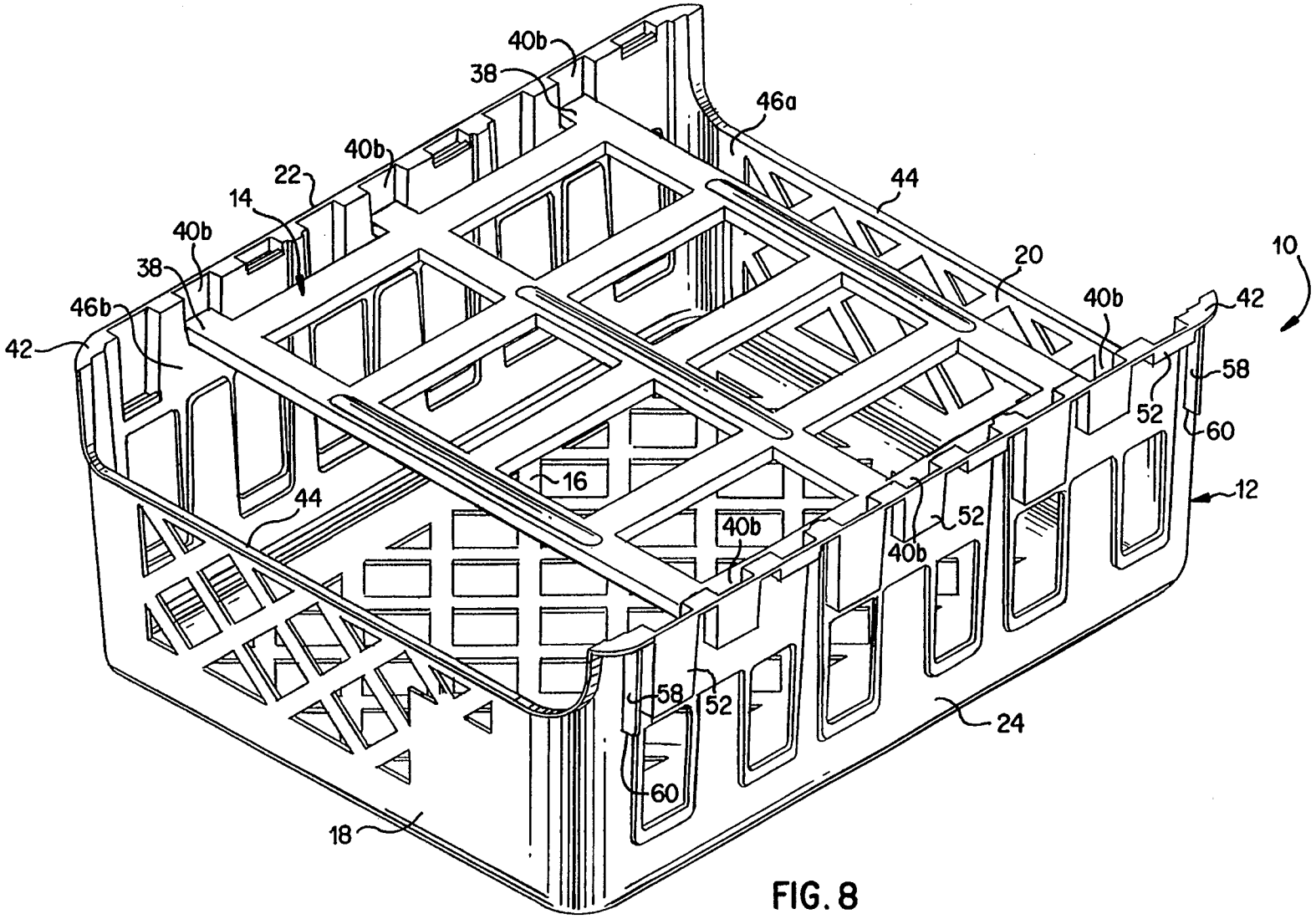
Figure 9:
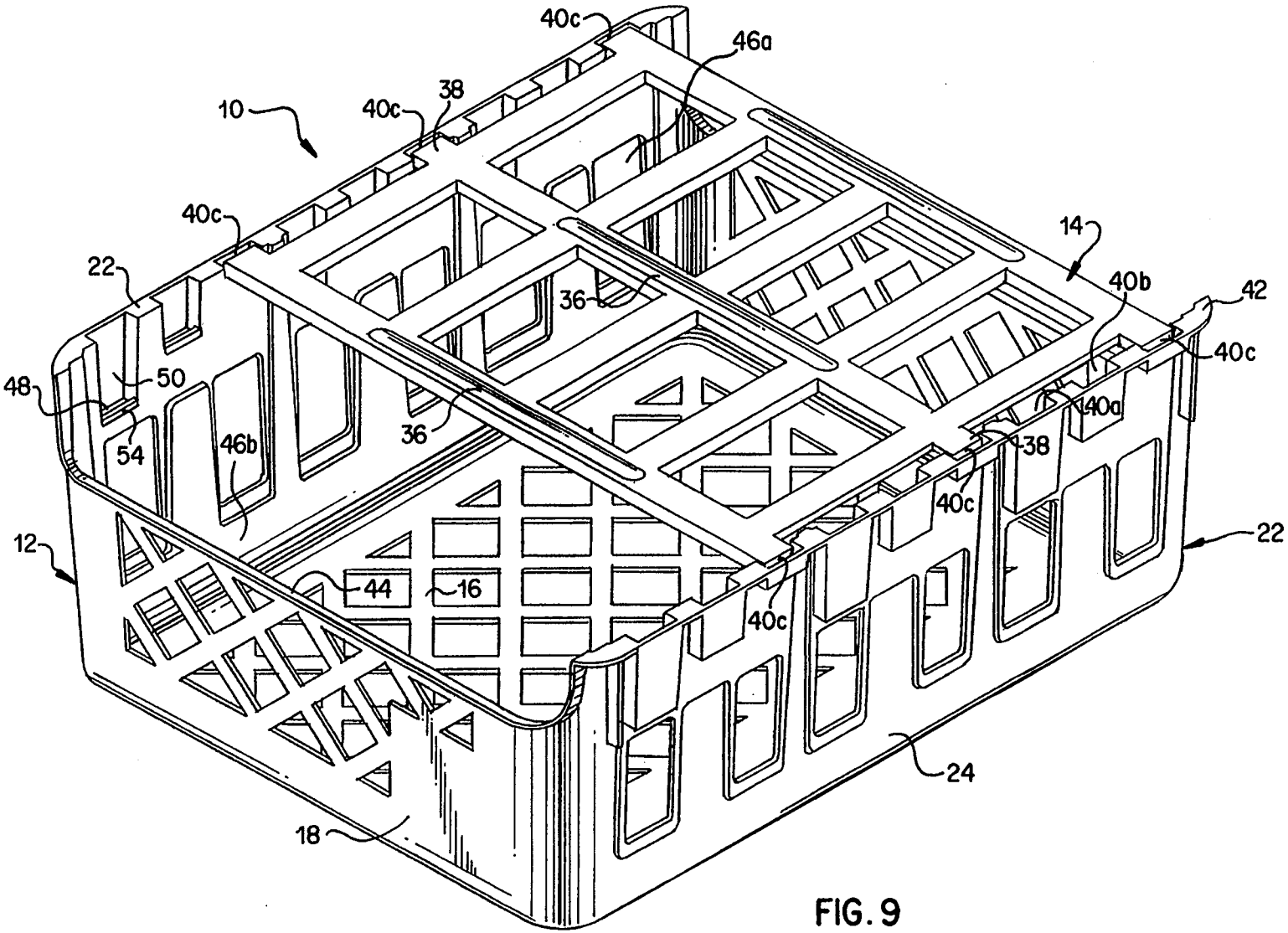

As is evident from the drawings, the seats 40 are arranged in groups each containing three seats disposed at progressively elevated levels, there being three such groups in each of the side walls. Thus, in the disclosed apparatus, each set of seats 40 comprises six seats, three on each of the respective side walls 22 and 24. The set indicated as 40*a* is adapted to mount the lid member 14 at its lowest elevation in the container body 12 (FIG. 7), as is desirable when bags having the smallest vertical height are stored in the container body. Similarly, the set comprising the seats indicated as 40*b* is disposed at an intermediate elevation suitable for mounting the lid member 14 when bags of intermediate size are stored in the container body (FIG. 8), while that comprising seats 40*c* operates to dispose the lid member at the highest elevation (FIG. 10) when bags having the greatest size are stored in the container body.

Figure 10:
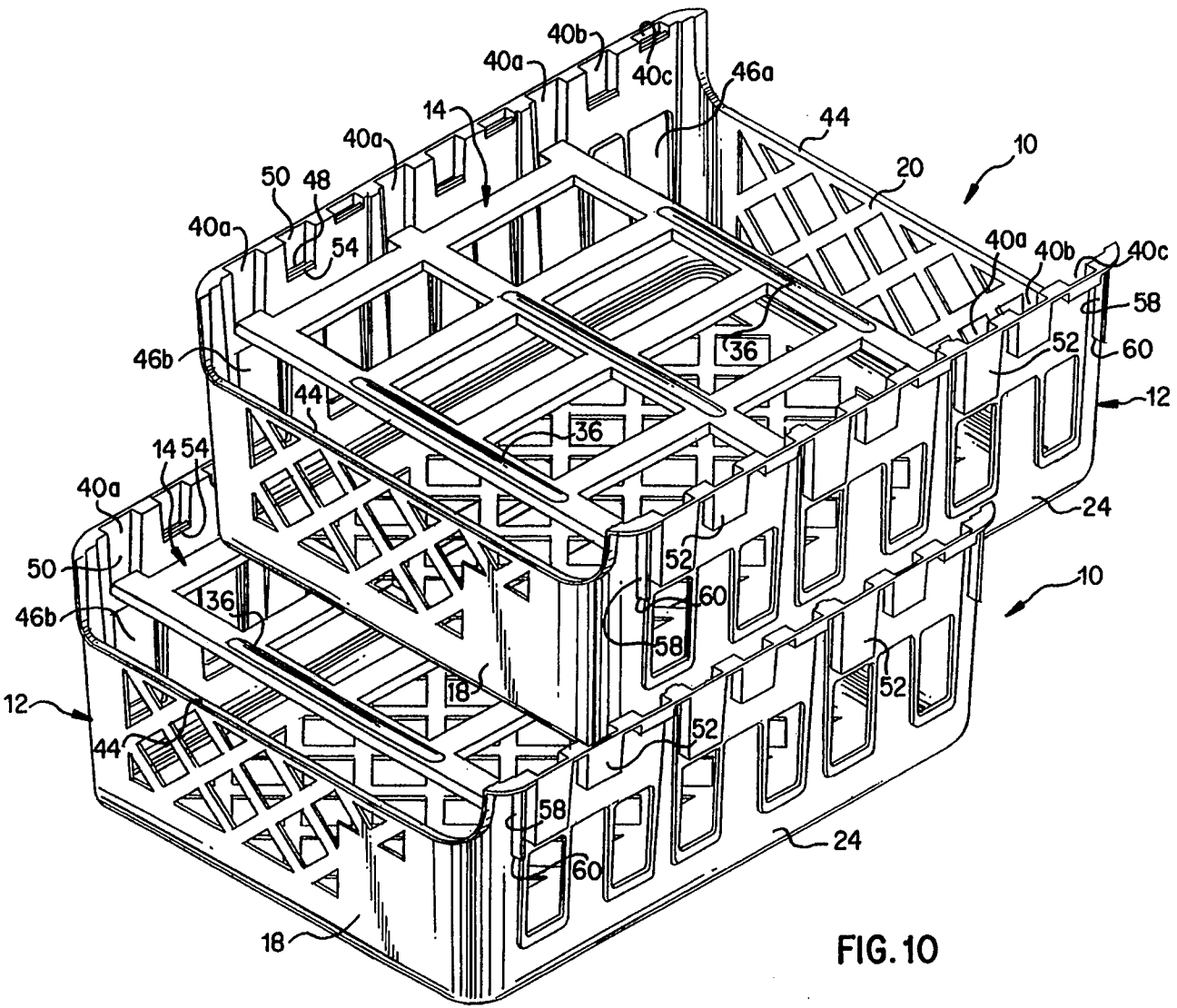
FIG. 10 is a perspective view illustrating a crate apparatus in an extended, stacked condition.
Figure 11:
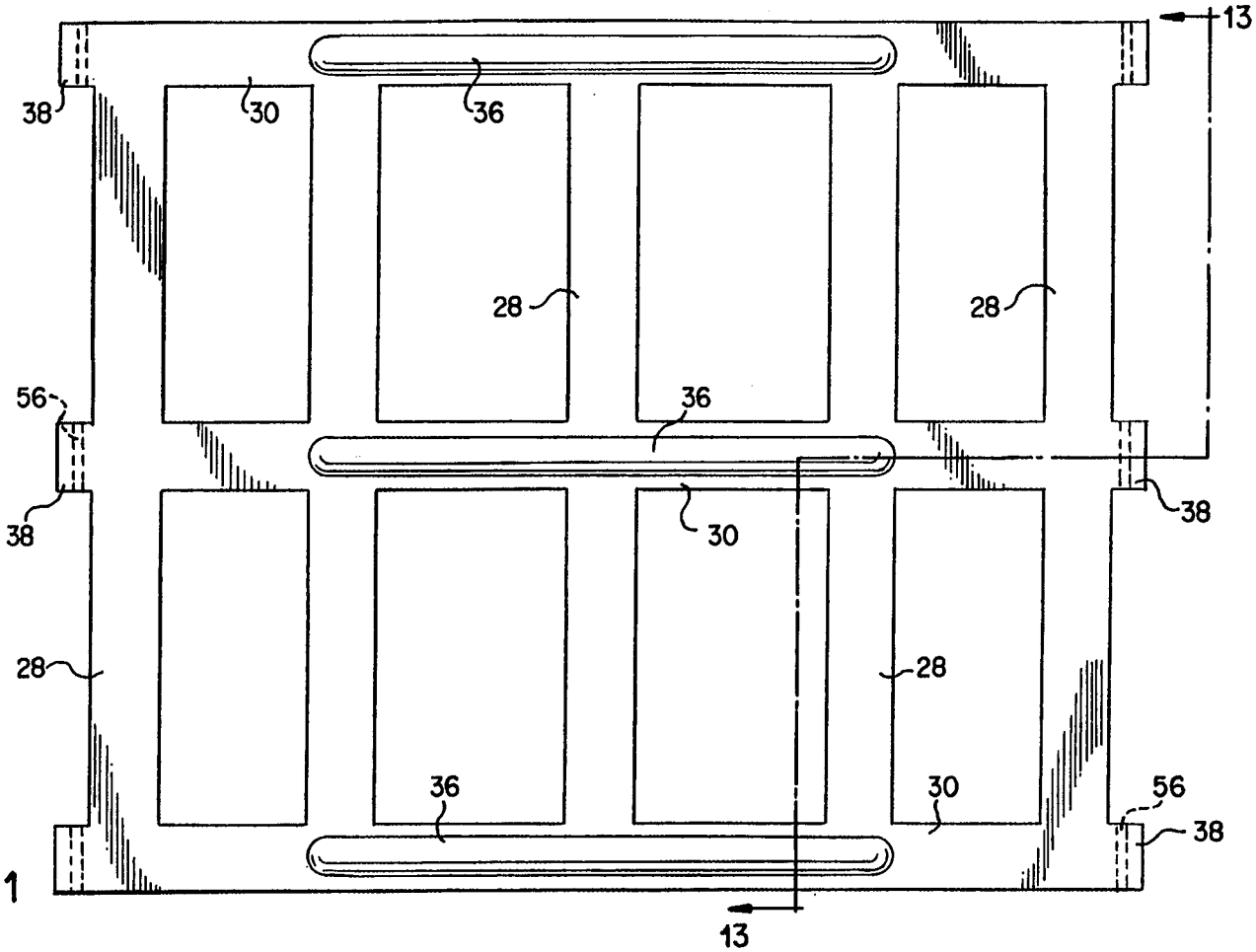
FIG. 11 is a top view of a lid member utilized in the crate apparatus of the present invention.

Advantageously, the lid member 14 on each crate apparatus 10 in a stack need not be mounted at the same elevation. On the contrary, crate apparatus as disclosed herein are particularly suitable, when stacked, to serve as drawers, the respective ones of which serve to dispense bags of different size depending upon which drawer-forming crate apparatus is slidingly moved to its extended position. This feature is as shown in FIG. 10.

The upward and outward inclination of the walls 18 to 24 facilitate nesting of the container bodies 12 for transport when empty. Vertically extending support struts 58 formed adjacent the intersections of the respective walls provide shoulders 60 at their bottom ends for engaging the upper edge of the subjacent container body in order to restrict the degree of nested penetration of the bodies. In the described arrangement, the struts 58 have a vertical length that prevents telescoping of the respective pockets 52 while permitting internested reception of the container bodies 12 to about two-thirds the depth of the subjacent body.

It will be appreciated that the present invention provides a plastic crate apparatus of versatile design in which, due to the adjustability of the lid member 14, the effective depth of the container bodies 12 can be altered in accordance with the size of the product stored therein, thereby enhancing the utilization of available space. The described apparatus further provides an inexpensive thin walled construction having superior strength characteristics allowing the stacking of many tiers of crates. These characteristics make the apparatus particularly desirable for warehouse storage of the contained product as well as commercial display. This latter function is especially enhanced by the ability of the respective crate apparatus to be manipulated in a drawer-like manner whereby access to the interior of the crates for removal of the product stored therein is obtained.

It will be understood that various changes in the details materials and arrangement of parts which have been described and illustrated herein in order to explain the nature of the invention may be made by those skilled in the art within the principle and scope of the invention as expressed in the appended claims.

I claim:

1. A stackable/nestable crate apparatus, comprising:

a container body including a bottom wall and a plurality of generally rectangularly disposed front, back and side walls extending upwardly from said bottom wall to define an open means forming a lid operative for stackedly supporting a similarly formed container body thereon adapted to extend across the open top of said container body in spaced, substantially parallel relation to said bottom wall; and means for selectively mounting said lid on said container body at a plurality of vertically spaced levels with respect to said container body bottom wall, said mounting means comprising a plurality of sets of seats formed in said upstanding walls, each of said sets of seats being adapted to mount said lid in an attitude substantially parallel to said bottom wall and each being disposed at a different level with respect thereto;

wherein said lid includes a lid body and means disposed about the periphery of said lid body for selective mounted engagement in the seats of the respective sets; and wherein each of said seats is defined by a shoulder disposed on the inwardly facing surface of said upstanding walls and adapted to receive said engagement means.

2. A stackable/nestable crate apparatus according to claim 1 including means on said lid for engaging an adjacent, stacked crate apparatus to arrest relative sliding movement between said crate apparatus.

3. A stackable/nestable crate apparatus according to claim 1 in which each of said seat sets includes a plurality of seats disposed on said walls at mutually spaced locations to supportably secure said lid in parallel relation with respect to said bottom wall.

4. A stackable/nestable crate apparatus according to claim 3 in which each of said seats is defined by a substantially closed bottom end of a vertically extending groove extending downwardly along the interior surface of an associated wall.

5. A stackable/nestable crate apparatus according to claim 4 in which said grooves are provided with an open upper end.

6. A stackable/nestable crate apparatus according to claim 5 in which said grooves are contained in pockets disposed in longitudinally spaced arrangement along opposed walls of said container body.

7. A stackable/nestable crate apparatus according to claim 3 in which said sets of seats each include a plurality of seats at rectangularly spaced locations about said upstanding walls.

8. A stackable/nestable crate apparatus according to claim 7 in which seats corresponding in the respective sets are arranged in groups disposed at longitudinally spaced location along opposed of said upstanding walls, each of said groups containing a plurality of seats positioned on mutually vertically spaced disposition.

9. A crate apparatus according to claim 8 in which said groups of seats are disposed in said opposed side walls.

10. A stackable/nestable crate apparatus according to claim 1 in which said lid comprises a plate-like body.

11. A crate apparatus according to claim 10 in which said container body has an interior space that has a length that is longer in a direction parallel to the longitudinal axis of said container body as compared with that in a direction parallel to the transverse axis thereof.

12. A crate apparatus according to claim 11 in which said lid body is sized to be longer in the direction adapted to extend parallel to the transverse axis of said container body as compared with that adapted to extend parallel to the longitudinal axis thereof.

13. A crate apparatus according to claim 12 in which said lid body is sized to be received on said container body bottom wall when rotated to place its longer dimension substantially parallel to the longitudinal axis of said container body.

14. A stackable/nestable crate apparatus according to claim 10 in which said engagement means on said lid body comprises a plurality of feet projecting from said body and adapted for reception in the seats of a selected set.

15. A stackable/nestable crate apparatus according to claim 10 in which each of said shoulders is adapted to receive one of said feet.

16. A stackable/nestable crate apparatus according to claim 15 in which said groove opens at its upper end in the upper edge of said upstanding wall.

17. A stackable/nestable cram apparatus according to claim 15 including means forming a rib on one of a seat-forming shoulder and an associated lid body foot and a conforming rib-receiving groove in the other for securing said foot with respect to said shoulder.

18. A stackable/nestable crate apparatus according to claim 15 in which each of said seat-forming shoulders is disposed at the bottom end of an upwardly extending groove formed on the internal surface of an upstanding wall.

19. A stackable/nestable crate apparatus according to claim 18 in which said groove is contained in a pocket projecting outwardly from the exterior side of said upstanding wall.

20. A stackable/nestable crate apparatus according to claim 14 in which said feet are located at least on generally rectangularly arranged disposition about the periphery of said lid.

21. A crate apparatus according to claim 20 in which said lid body has a generally rectangular periphery and said feet are disposed at least each substantially at the respective corners of said body.

22. A stackable/nestable crate apparatus according to claim 21 in which said lid body has an effective width dimension coincident with that of said container body and an effective length dimension significantly less than that of said container body to define, when operatively mounted on said container body, an access opening at least at one end thereof.

23. A stackable/nestable crate apparatus according to claim 21 in which the effective peripheral dimensions of said lid body are less than those of the interior of said container body whereby said lid can be stored in said container body when said container bodies are stacked.

24. A crate apparatus according to claim 1 in which at least one of said front and back walls has an upper edge containing an elongated recess dimensioned to enable passage therethrough of a container body supported for sliding movement on said lid body.

25. A crate apparatus according to claim 24 in which the intersection between said bottom wall and each of said side walls is formed by an arcuately-formed interconnection and said elongated recess has a shape at its opposite ends substantially conforming to that of said interconnection.

26. A stackable/nestable crate apparatus according to claim 10 in which the body of said lid includes means on its upper surface engageable with the bottom wall of a stacked crate apparatus to arrest relative sliding movement between adjacent crate apparatus.

27. A stackable/nestable crate apparatus according to claim 26 in which said arresting means comprises means forming at least one rib-like projection extending transversely of the upper surface of said lid body.

28. A stackable/nestable crate apparatus according to claim 27 including means forming a projection depending from the bottom wall of said container body and engageable with the arresting means on the lid of a stacked subjacent crate apparatus.

29. A stackable/nestable crate apparatus according to claim 28 in which said projection from said container body bottom wall is a rectangularly formed wear rib.

30. A stackable/nestable crate apparatus, comprising:

a container body including a bottom wall and a plurality of generally rectangularly disposed front, back and side walls extending upwardly from said bottom wall to define an open top;

means forming a lid operative for stackedly supporting a similarly formed container body thereon adapted to extend across the open top of said container body in spaced, substantially parallel relation to said bottom wall, said lid comprising a plate-like body;

means for selectively mounting said lid on said container body at a plurality of vertically spaced levels with respect to said container body bottom wall;

means disposed about the periphery of said lid body for selective mounted engagement in the seats of the respective sets, said engagement means on said lid body comprising a plurality of feet projecting from said body and adapted for reception in the seats of a selected set; and wherein each of said seats is defined by a shoulder adapted to receive one of said feet and being disposed on the inwardly facing surface of said upstanding walls.

31. A stackable/nestable crate apparatus, comprising:

a container body including a bottom wall and a plurality of generally rectangularly disposed front, back and side walls extending upwardly from said bottom wall to define an open top;

means forming a lid operative for stackedly supporting a similarly formed container body thereon adapted to extend across the open top of said container body in spaced, substantially parallel relation to said bottom wall; and means for selectively mounting said lid on said container body at a plurality of vertically spaced levels with respect to said container body bottom wall, said mounting means comprises a plurality of sets of seats formed in said upstanding walls, each of said sets of seats being adapted to mount said lid in an attitude substantially parallel to said bottom wall and each being disposed at a different level with respect thereto;

wherein each of said seat sets includes a plurality of seats disposed on said walls at mutually spaced locations to supportably secure said lid in parallel relation with respect to said bottom wall and each of said seats is defined by a substantially closed bottom end of a vertically extending groove extending downwardly along the interior surface of an associated wall.

32. A stackable/nestable crate apparatus, comprising:

a container body including a bottom wall and a plurality of generally rectangularly disposed front, back and side walls extending upwardly from said bottom wall to define an open top;

means forming a lid operative for stackedly supporting a similarly formed container body thereon adapted to extend across the open top of said container body in spaced, substantially parallel relation to said bottom wall; and means for selectively mounting said lid on said container body at a plurality of vertically spaced levels with respect to said container body bottom wall;

wherein at least one of said front and back walls has an upper edge containing an elongated recess dimensioned to enable passage therethrough of a container body supported for sliding movement on said lid body.

* * * * *